US009326352B2

(12) United States Patent
Marie et al.

(10) Patent No.: US 9,326,352 B2
(45) Date of Patent: Apr. 26, 2016

(54) PORTABLE ELECTRIC LAMP WITH A POWER SUPPLY CURRENT CONTROL DEVICE AND METHOD FOR CONTROLLING A POWER SUPPLY CURRENT OF SUCH A LAMP

(71) Applicant: ZEDEL, Crolles (FR)

(72) Inventors: Christophe Marie, Le Versoud (FR); Stéphanie Chancelade, Grenoble (FR); Nicolas Flores, Gieres (FR)

(73) Assignee: ZEDEL, Crolles (FR)

( * ) Notice: Subject to any disclaimer, the term of this patent is extended or adjusted under 35 U.S.C. 154(b) by 200 days.

(21) Appl. No.: 13/951,866

(22) Filed: Jul. 26, 2013

(65) Prior Publication Data

US 2014/0028195 A1 Jan. 30, 2014

(30) Foreign Application Priority Data

Jul. 27, 2012 (FR) ..... 12 02133

(51) Int. Cl.
*H05B 37/02* (2006.01)
*H05B 33/08* (2006.01)

(52) U.S. Cl.
CPC ..... *H05B 37/02* (2013.01); *H05B 33/0848* (2013.01)

(58) Field of Classification Search
CPC ..... G11C 11/00; G11C 11/23; H05H 3/00; H05H 3/06; H01J 1/00; H01J 1/16; H01J 1/18; H01J 1/94; H01J 27/00; H01J 27/022; H01J 29/00; H01J 29/395; H01J 3/00; H01J 3/04; H01J 3/027; H01J 31/00; H01J 31/18; H01J 31/60; H01J 31/64; H01J 35/00; H01J 35/06; H01J 43/00; H01J 9/00; H01J 9/18
USPC ..... 315/12.1
See application file for complete search history.

(56) References Cited

U.S. PATENT DOCUMENTS

| | | | | |
|---|---|---|---|---|
| 7,119,459 | B2 * | 10/2006 | Bruwer et al. | 307/140 |
| 2010/0219775 | A1 | 9/2010 | Maglica et al. | |
| 2011/0031901 | A1 * | 2/2011 | Huguenin et al. | 315/307 |
| 2011/0221347 | A1 * | 9/2011 | Bae et al. | 315/129 |
| 2011/0227500 | A1 | 9/2011 | West | |
| 2012/0104954 | A1 * | 5/2012 | Huang | 315/158 |

FOREIGN PATENT DOCUMENTS

FR 2 930 706 A1 10/2009

* cited by examiner

*Primary Examiner* — John Poos
*Assistant Examiner* — David Mattison
(74) *Attorney, Agent, or Firm* — Oliff PLC

(57) ABSTRACT

A portable electric lamp including a lighting module, a compact housing enclosing an electric power storage unit configured to provide a power supply current to the lighting module, means for measuring a current consumed by the lighting module, determination means configured to generate a lighting current set point, calculation means for calculating a maximum authorized current from a difference between the consumed current and a reference current and for calculating a maximum authorized current threshold from the minimum value between the lighting current set point and the maximum authorized current, and limiting means configured to limit the power supply current to a value lower than or equal to the maximum authorized current threshold.

18 Claims, 2 Drawing Sheets

PORTABLE ELECTRIC LAMP WITH A POWER SUPPLY CURRENT CONTROL DEVICE AND METHOD FOR CONTROLLING A POWER SUPPLY CURRENT OF SUCH A LAMP

BACKGROUND OF THE INVENTION

The invention relates to a portable electric lamp with a power supply current control device and to a method for controlling a power supply current of such a lamp, especially an electric headlamp having a compact housing.

STATE OF THE ART

Currently, low-bulk portable electric lamps comprising a lighting module housed in a compact housing are used. Generally, the lamp comprises a support provided with a strap enabling to wear the lamp one's head.

Such lamps may be provided with light-emitting diodes, LED, providing a strong lighting, especially for a lighting during daytime activities, which are highly power consuming. Such lamps however do not enable to guarantee an autonomous operation to a user, whatever his activity. Autonomous operation means a time during which the lamp can operate without any new power input or without any outer intervention.

SUMMARY OF THE INVENTION

The object of the invention is to overcome such disadvantages, and in particular to provide means for controlling the current supplied to a lighting module of a sufficiently compact portable electric lamp, to guarantee an autonomous operation and an optimized lighting level for the user.

According to an aspect of the invention, a portable electric lamp comprising a lighting module, a compact housing enclosing an electric power storage unit configured to provide a power supply current to the lighting module is provided.

The lamp comprises means for measuring a current consumed by the lighting module, determination means configured to determine a lighting current set point, calculation means for calculating an average current threshold equal to the ratio of an initial capacity of the storage unit to a lamp autonomy time, to calculate a maximum authorized current from a difference between the consumed current and the average current threshold and to calculate a maximum authorized current threshold from the minimum value between the lighting current set point and the maximum authorized current, and limiting means configured to limit the power supply current to a value smaller than or equal to the maximum authorized current threshold.

Thus, a maximum current threshold not to be exceeded can be determined to provide an optimized power supply current when the lamp is being used. In particular, the difference between the consumed current and the average current threshold enables to take into account current consumption differences, which reflect the way in which the lighting module has consumed the available current, that is, in an economical way or not. Thus, the current provided to the lighting unit for a determined autonomy time can be optimized to guarantee a minimum lighting power during this time period.

According to a general aspect of the invention, a portable electric lamp is provided, which comprises a lighting module, a compact housing enclosing an electric power storage unit configured to provide a power supply current to the lighting module, means for measuring a current consumed by the lighting module, determination means configured to generate a lighting current set point, calculation means for calculating a maximum authorized current from a difference between the consumed current and a reference current and for calculating a maximum authorized current threshold from the minimum value between the lighting current set point and the maximum authorized current, and limiting means configured to limit the power supply current to a value smaller than or equal to the maximum authorized current threshold.

The calculation means may calculate the reference current from an initial capacity of the storage unit and a lamp autonomy time.

The calculation means may further calculate the reference current from a remaining capacity of the storage unit and a remaining lamp service time.

The lamp may comprise an optical sensor configured to generate a signal representative of the lighting induced by the lamp, the determination means being configured to generate the lighting current set point from the generated signal.

The external lighting in the vicinity of the lamp may also be taken into account to control the power supply current in order to optimize the electric power saving.

The measurement means may be configured to periodically measure the current consumed by the lighting module during a determined time period, and the calculation means are configured to periodically calculate the maximum authorized current and the maximum authorized current threshold for each determined time period.

Thereby, the measurement of the consumed current is refined to obtain a better accuracy regarding the calculation of the maximum authorized current threshold.

The lamp may comprise estimation means configured to estimate the initial capacity of the storage unit from a coefficient representative of the aging of the storage unit estimated from a number of full charges of the storage unit or from an internal resistance of the storage unit.

This thus enables to guarantee an autonomy of the lamp during the entire lifetime of the storage unit.

According to another aspect of the invention, a method for controlling a power supply current provided by an electric power storage unit to a lighting module of a portable electric lamp is provided.

The method comprises the generation of a maximum authorized current threshold, comprising measuring a current consumed by the lighting module, generating a lighting current set point, calculating an average current threshold equal to the ratio of an initial capacity of the storage unit to a lamp autonomy time, calculating a maximum authorized current from a difference between the consumed current and the average current threshold, calculating the maximum authorized current threshold from the minimum value between the lighting current set point and the maximum authorized current, the method further comprising the limitation of the power supply current to a value lower than or equal to the maximum authorized current threshold.

According to another general aspect of the invention, a method for controlling a power supply current provided by an electric power storage unit to a lighting module of a portable electric lamp is provided, the method comprising the generation of a maximum authorized current threshold comprising measuring a current consumed by the lighting module, generating a lighting current set point, calculating a maximum authorized current from a difference between the consumed current and a reference current, calculating the maximum authorized current threshold from the minimum value between the lighting current set point and the maximum authorized current, the method further comprising the limitation of the power supply current to a value lower than or equal to the maximum authorized current threshold.

The reference current may be calculated from an initial capacity of the storage unit and a lamp autonomy time.

The reference current may further be calculated from a remaining capacity of the storage unit and a remaining lamp service time.

The lighting current set point may vary according to a lighting induced by the lamp.

The step of generation of the maximum authorized current threshold may be carried out periodically during a determined time period, and the current consumed by the lighting module during the determined time period is measured.

The method may comprise estimating the initial capacity of the storage unit from a coefficient representative of the aging of the storage unit estimated from a number of full charges of the storage unit or from an internal resistance of the storage unit.

BRIEF DESCRIPTION OF THE DRAWINGS

The foregoing and other features and advantages of the present invention will be discussed in detail in the following non-limiting description of specific embodiments in connection with the accompanying drawings, among which.

DETAILED DESCRIPTION

Figure 1:
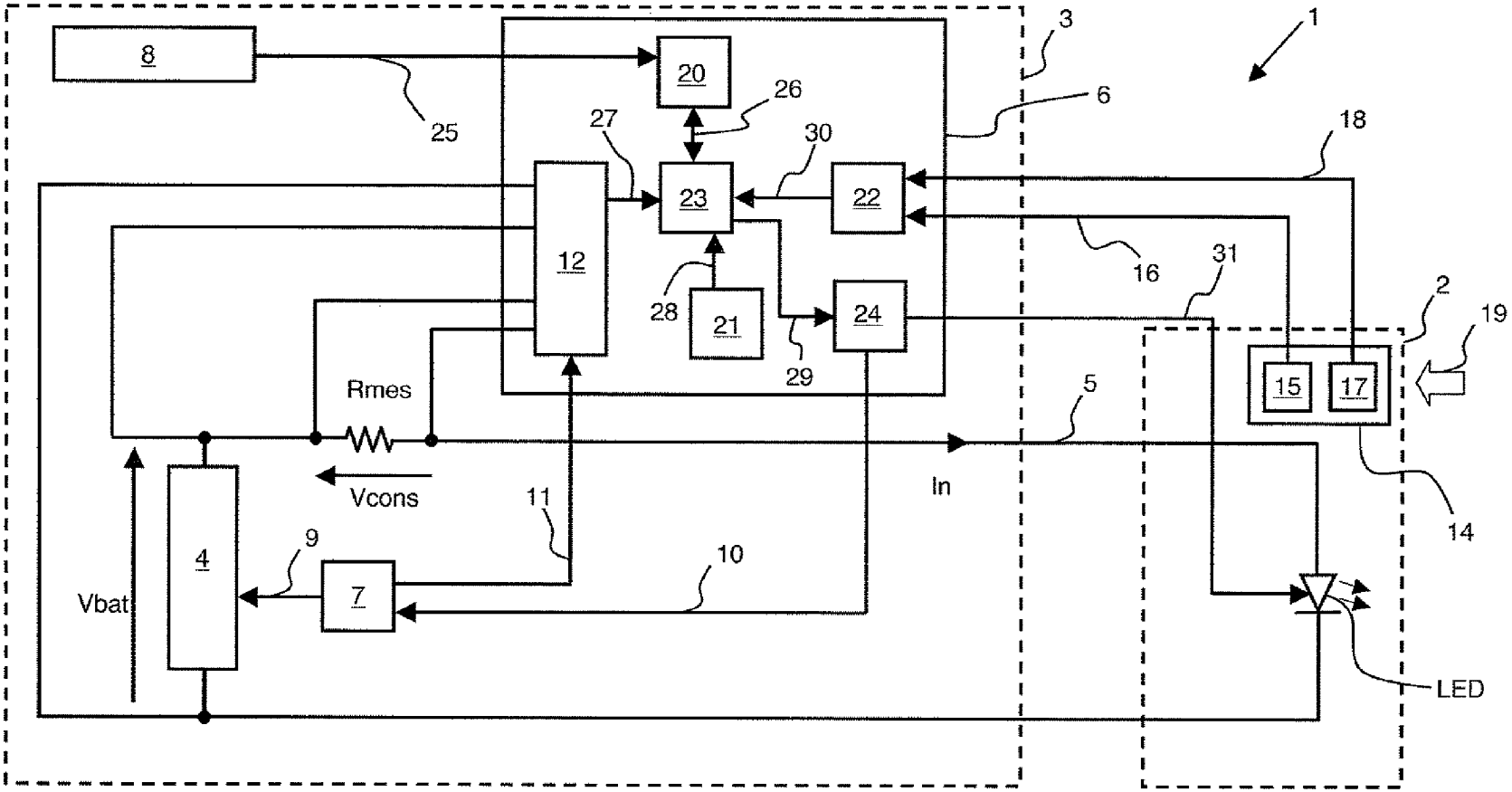
FIG. 1 schematically illustrates an embodiment of a portable electric lamp according to the invention.

FIG. 1 schematically shows a portable electric lamp 1 comprising a lighting module 2 and a compact housing 3 enclosing an electric power storage unit 4 such as a cell or a battery. Unit 4 is configured to provide a power supply current In, via an electric circuit 5, to lighting module 2. Unit 4 preferably is a rechargeable power storage unit configured to store electric power in chemical form during the charge and to restore part of this electric power during the discharge. Lighting module 2 preferably comprises a light-emitting diode (LED) or may also comprise several LEDs, especially LEDs with a high lighting power. Portable electric lamp 1 may be a headlamp, or a flashlight, and compact housing 3 may be made of an insulating or metallic material. According to an embodiment, lighting module 2 is separated from compact housing 3. According to another embodiment, lighting unit 2 is included within compact housing 3.

Further, housing 3 comprises a control device 6, such as for example an electronic control unit, configured to control power supply current In provided by storage unit 4 to lighting module 2. Housing 3 may further comprise a component 7 for managing storage unit 4, a measurement resistor Rmes, and lamp 1 may comprise an input module 8. Management component 7 enables to control, via a connection 9, the charges and discharges of unit 4. Management component 7 is controlled by control device 6 via a connection 10, and transmits, via a connection 11, state parameters of unit 4, such as parameters representative of the capacity of storage unit 4, such as a remaining capacity of the storage unit CapaRest, a start capacity of the storage unit CapaDem, a consumed capacity of the storage unit CapaCons. Capacity of the storage unit here means the amount of electricity that the storage unit can return during a discharge. Measurement resistor Rmes enables to measure a consumed current Icons corresponding to power supply current In provided to lighting module 2 during a determined cycle time Tcycle. Resistor Rmes is series-assembled between electric power storage unit 4 and the LED. Control unit 6 comprises measurement means 12 coupled at the terminals of resistor Rmes. Measurement means 12 measure a voltage Vcons at the terminals of resistor Rmes to measure consumed current Icons according to relation:

$$Icons = Vcons/Rmes \quad \text{(equation 1)}$$

with:

Icons: the power supply current provided to the LED during determined cycle time Tcycle, that is, the current consumed by the LED during time Tcycle;

Vcons: the voltage at the terminals of resistor Rmes;

Rmes: the value of resistance Rmes.

Further, measurement means 12 are also coupled at the terminals of unit 4, for measuring a voltage Vbat at the terminals of unit 4, and to be able to measure an internal resistance Rint of unit 4. For example, internal resistance Rint may be measured by measuring a first voltage Vbat1 at the terminals of unit 4 and a first current Icons1 consumed by the LED. Then, a second voltage Vbat2 at the terminals of unit 4 and a second current Icons2 consumed by the LED are measured. Thus, the value of internal resistance Rint can be measured according to relation:

$$Rint = (Vbat1 - Vbat2)/(Icons1 - Icons2). \quad \text{(equation 2)}$$

Due to the measurement of internal resistance Rint, another mode of calculation of the state parameters of unit 4 can be provided. Indeed, measurement means 12 can thus determine:

$$CapaDem = (Vbat_charge/Rint) * Tcharge \quad \text{(equation 3)}$$

$$CapaCons = (Vbat_f/Rint) * Tcycle \quad \text{(equation 4)}$$

with

CapaDem: the start capacity of the storage unit, that is, the capacity at the beginning of the use of lamp 1;

CapaCons: the consumed capacity of the storage unit, that is, the capacity consumed during determined cycle time Tcycle;

Vbat_charge: the charge voltage of unit 4;

Vbat_f: the voltage provided by unit 4 to the LED during time Tcycle;

Tcharge: the charge time of unit 4.

It should be noted that the charge of storage unit 4 may be complete or incomplete, and that determined cycle time Tcycle corresponds to a discharge time of the unit during which unit 4 delivers current Icons to the LED.

Further, input module 8 is configured to transmit to control device 6 input parameters keyed in by the user. The input parameters may be a maximum illumination threshold SeuilMax, a minimum illumination threshold SeuilMin, and a desired time Dauto of autonomous operation of lamp 1. The maximum and minimum lighting thresholds enable the user to select a lighting power interval that he desires to use for its activity. Autonomy time Dauto corresponds to the time period for which the user desires to carry out his activity. Especially based on the parameters input by the user, control device 6 controls the value of power supply current In delivered to the LED to guarantee for the user a minimum lighting during autonomy time Dauto. Further, control device 6 provides a lighting optimized for a maximum lighting during autonomy time Dauto. Input module 8 may be comprised within housing 3 or within lighting module 2, or be transferred within an external computer.

Further, lighting module 2 comprises a generation module 14 for generating a lighting set point. Generation module 14 comprises a lighting button 15 for providing a lighting control signal Cmde via a connection 16, to control device 6. Lighting control signal Cmde is a function of a lighting power selected by the user via lighting button 15. The lighting power may correspond to a low, strong, minimum, or maximum lighting power. Lighting button 15 further enables to turn lamp 1 on or off. Preferably, generation module 14 further comprises an optical sensor 17 which provides control device 6, via a connection 18, with a signal S representative of a lighting 19 induced by lamp 1. In particular, signal S is representative of the light reflected by an illuminated object, especially by the LED, and by other light sources external to lamp 1. Optical sensor 17 reinforces the automation of the control of power supply current In since it enables to automatically select the lighting power necessary to sufficiently illuminate an object.

Control device 6 comprises a non-volatile memory 20, an electronic clock 21, determination means 22, previously-described measurement means 12, calculation means 23, and limiting means 24 for limiting power supply current In provided to the LED.

Non-volatile memory 20 is coupled to input module 8 by a connection 25 to save the parameters input by the user. Further, memory 20 is coupled to calculation means 23 by a connection 26 to save other calculated parameters and to transmit the saved parameters to calculation means 23. Non-volatile memory 20 enables to keep the values of the saved parameters even after lamp 1 has stopped.

Measurement means 12 transmit measured parameters Icons, CapaDem, CapaCons, to calculation means 23 over a connection 27. Electronic clock 21 is configured to provide current time Tcourant, that it transmits over a connection 28, to calculation means 23.

Determination means 22 generate a lighting current set point either from received signal S, or from received control signal Cmde, and transmit lighting current set point Id to calculation means 23 over a connection 30. Preferably, lighting current set point Id is generated from signal S, and it is inversely proportional to the amount of light received by optical sensor 17. In other words, the higher the amount of light received by optical sensor 17, the lower lighting current set point Id. Thus, the lighting power of the LED is decreased when an object is under strong lighting, and conversely. According to still another variation, determination means 22 generate a lighting current set point Id having a constant value equal to that of an average current threshold Imoyen.

Further, calculation means 23 are configured to generate a maximum authorized current threshold SeuilMaxAuto, that they transmit over a connection 29 to limiting means 24. Maximum authorized current threshold SeuilMaxAuto corresponds to a maximum power supply current not to be exceeded to guarantee the operation of lamp 1 during the desired autonomy time Dauto. Further, limiting means 24 are coupled by a connection 31 to the LED to limit power supply current In by directly controlling the LED. As a variation, limiting means 24 control management component 7 of unit 4 to control the discharges in order to limit power supply current In to a value lower than or equal to SeuilMaxAuto.

Generally, measurement means 12 periodically measure current Icons consumed by the LED during determined cycle time Tcycle. Based on the measured consumed current Icons, calculation means 23 generate an intermediate parameter NEDisp, also called available electric power level, which is representative of the way in which lamp 1 has consumed current, that is, economically or not. In particular, available power level NEDisp is generated from the difference between consumed current Icons and average current threshold Imoyen. Further, the value of parameter NEDisp is periodically saved at each cycle time Tcycle, and each new value of the parameter is calculated from the previous saved value. Thus, the previous events are taken into account, in addition to the current consumption mode, to determine the value of maximum authorized current threshold SeuilMaxAuto not to be exceeded. The current consumption of the LED may correspond to an overconsumption, in the case where that the current that has been consumed since the beginning of the use of lamp 1 is considered to be too high, that is, that the current consumption has exceeded a determined threshold. Conversely, it may correspond to an underconsumption in the case the current which has been consumed is considered to be lower than the determined threshold. The determined threshold corresponds to average current threshold Imoyen that the storage unit is capable of providing during autonomy time Dauto. Calculation means 23 determine, for each new cycle time Tcycle, the new value of intermediate parameter NEDisp based on its old value, saved at the previous cycle time, and on the difference between current Icons consumed during the previous cycle time and average current threshold Imoyen. The value of intermediate parameter NEDisp is positive or zero during a overconsumption of current, or negative during an underconsumption. Then, calculation means 23 generate a maximum authorized current ImaxAuto from intermediate parameter NEDisp. Current ImaxAuto corresponds to a current not to be exceeded to guarantee the autonomy of operation of lamp 1. Further, the lighting of lamp 1 is optimized by taking into account lighting current set point Id. More specifically, when intermediate parameter NEDisp is positive or zero, in the case of an overconsumption, control device 6 limits power supply current In to the minimum value between lighting current set point Id and maximum authorized current ImaxAuto. If intermediate parameter NEDisp is negative, in the case of an underconsumption, control device 6 limits the power supply current to the value of current set point Id. Thus, an optimized lighting which does not exceed maximum authorized current ImaxAuto, in overconsumption, and does not exceed lighting current set point Id in underconsumption is provided. In other words, maximum authorized current threshold SeuilMaxAuto is equal to the minimum value between lighting current set point Id and maximum authorized current ImaxAuto when the available electric power level NEDisp is positive or zero, and maximum authorized current threshold SeuilMaxAuto is equal to lighting current set point Id when available electric power level NEDisp is negative.

Initially, calculation means 23 recover the value of the capacity at the starting of storage unit CapaDem, either via measurement means 12, or via component 7 for managing unit 4. Advantageously, the aging of storage unit 4 may be taken into account to refine the value of parameter CapaDem. The aging may be estimated, for example, by storing by means of non-volatile memory 20 the number of full charges carried out and by using a first abacus of the manufacturer of unit 4 to determine an aging coefficient CoefVieil. Then, an initial capacity of storage unit CapaInit=CapaDem*CoefVieil is estimated (equation 5). According to another estimation mode, the internal resistance of battery Rint may be measured, as described hereabove at equation 2, and aging coefficient CoefVieil may be determined from Rint and from a second abacus of the manufacturer of unit 4. Initial capacity CapaInit corresponds to the amount of electric power that storage unit 4 can return when lamp 1 is put into service.

Then, the user inputs parameters SeuilMax, SeuilMin, and Dauto from input module 8. Such parameters are then processed by calculation means 23 to determine their validity. For example, the input maximum lighting threshold SeuiMax cannot exceed a limit given by the manufacturer of the LED. Minimum lighting threshold SeuilMin cannot be lower than a minimum power supply current to enable the user to read a document, at a read distance approximately equal to 25 cm, in the dark. Further, if autonomy time Dauto is greater than a determined threshold DautoMax, its value is limited to determined threshold DautoMax=CapaInit/SeuilMin (equation 6). As a variation, maximum and minimum thresholds SeuilMax and SeuilMin may be previously set to constant values rather than input by the user. The same applies to autonomy time Dauto. In particular, minimum lighting threshold SeuilMin corresponds to the minimum power supply current that storage unit 4 is capable of providing during autonomy time Dauto.

Calculation means 23 then initialize certain parameters to the following determined values:

Tinit=DateInit, with Tinit: initial time which marks the beginning of the use of lamp 1, and DateInit: the date at which lamp 1 is put into service;

Dutil=0, with Dutil: the service time of lamp 1 from initial time Tinit;

Tcycle: the cycle time, for example, ranging between 10 ns and 1 minute;

NEDisp=0;

CapaUtil=0, with CapaUtil: the used storage unit capacity since initial time Tinit;

ImaxAuto=SeuilMax.

Preferably, Tcycle≤Dauto/10 to obtain a progressive control of power supply current In. Then, calculation means 23 recover consumed current Icons, transmitted by measurement means 12, and lighting current set point Id transmitted by determination means 22. Calculation means 23 then determine service time Dutil. For example, Dutil may be determined by relation Dutil=Dutil+Tcycle (equation 7), by incrementing at each cycle time Tcycle parameter Dutil saved in non-volatile memory 20. Dutil may further be determined by the following relation: Dutil=Tcourant+Tinit (equation 8), by recovering the value of current time Tcourant at each cycle time Tcycle.

Then, calculation means 23 calculate certain parameters to determine maximum authorized current ImaxAuto. Thus, calculation means 23 perform the following calculations:

$$Imoyen=CapaInit/Dauto \quad \text{(equation 9);}$$

$$CapaCons=Icons*Tcycle \quad \text{(equation 10);}$$

$$CapaUtil=CapaUtil+CapaCons \quad \text{(equation 11);}$$

$$CapaRest=CapaInit-CapaUtil \quad \text{(equation 12);}$$

$$NEDisp=NEDisp+(Icons-Imoyen*Margin)*Tcycle \quad \text{(equation 13);}$$

$$Ratio=NEDisp/CapaRest \quad \text{(equation 14);}$$

$$ImaxAuto=(SeuilMax-SeuilMin)*(1-Ratio) \quad \text{(equation 15);}$$

with

Imoyen: the average current threshold;

Margin: a security margin, in percentage, for example, equal to 90%;

Ratio: the ratio of available power level NEDisp to the remaining capacity of storage unit CapaRest; and NEDisp: unitless intermediate parameter which represents the electric consumption mode of the LED, that is, whether the consumption is economical or not.

According to an embodiment, calculation means 23 calculate these parameters at each cycle time Tcycle. As a variation, the state parameters of the storage unit capacity, CapaCons, CapaUtil, and CapaRest are determined by management component 7 and directly transmitted to calculation means 23. Advantageously, calculation means 23 limit the value of maximum authorized threshold ImaxAuto so that they are within interval [SeuilMin; SeuiMax]. If calculated value ImaxAuto is greater than SeuilMax, then ImaxAuto=SeuilMax and if calculated ImaxAuto is smaller than SeuilMin, then ImaxAuto=SeuilMin.

Generally, average current threshold Imoyen is also called reference current. Reference current Imoyen corresponds to an available current that storage unit 4 is capable of providing during the desired autonomy time Dauto. Calculation means 23 calculate reference current Imoyen from the initial capacity of storage unit CapaInit and the lamp autonomy time Dauto. In particular, reference current Imoyen is proportional to the ratio between initial storage unit capacity CapaInit and autonomy time Dauto. For example, reference current Imoyen=CapaInit/Dauto (equation 9).

According to another embodiment, calculation means 23 calculate reference current Imoyen from remaining storage unit capacity CapaRest and a remaining lamp service time Drest. For example, calculation means 23 calculate remaining lamp service time Drest=Dauto−Dutil. In particular, reference current Imoyen is proportional to the ratio between remaining storage unit capacity CapaRest and remaining lamp service time Drest. For example, reference current Imoyen=CapaRest/Drest. In this other embodiment, reference current Imoyen varies during lamp service time Dutil. For example, calculation means 23 calculate reference current Imoyen at each cycle time Tcycle.

Then, calculation means 23 determine maximum authorized current threshold SeuilMaxAuto from the previous parameters. Further, SeuilMaxAuto=Id, if NEDisp≥0 and Dutil<Dauto; and SeuilMaxAuto=ImaxAuto, if NEDisp<0 and Dutil≥Dauto.

When the LED consumes little current, that is, in underconsumption, the power stored by unit 4 has been saved, and NEDisp<0. In this case, the current provided to the LED by limiting power supply current In to the value of lighting current set point Id is optimized. Conversely, when the LED consumes too much current, that is, in overconsumption, the stored power has not been sufficiently saved, and NEDisp≥0. In this case, the current provided to the LED is optimized by limiting power supply current In to the minimum value between maximum authorized current ImaxAuto and lighting current set point Id. It may also be envisaged to supply the LED with a power supply current In equal to the value of maximum authorized current threshold SeuilMAxAuto.

Figure 2:
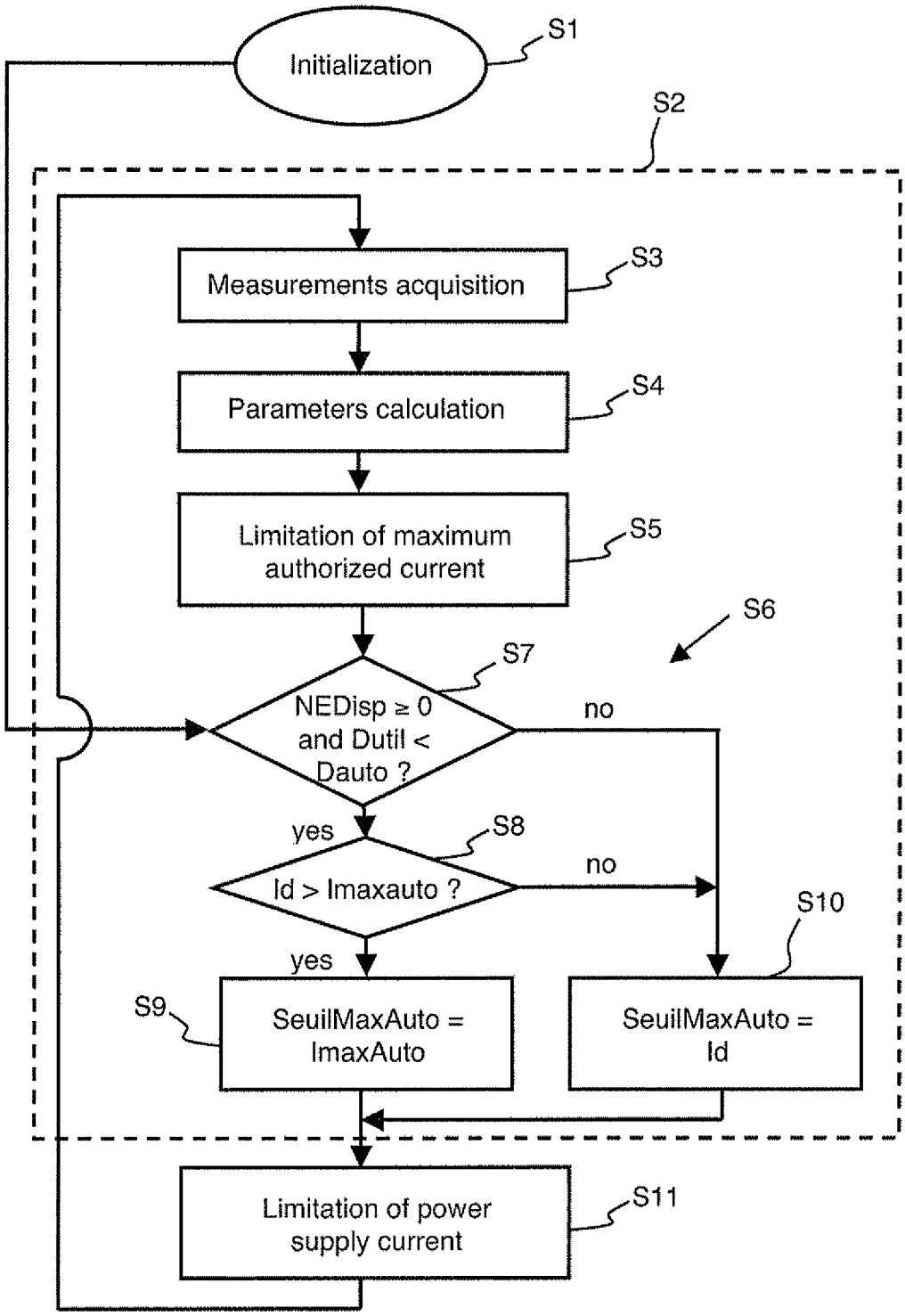
FIG. 2 schematically illustrates the main steps of a method for controlling a power supply current of the portable electric lamp of FIG. 1.

FIG. 2 schematically shows the main steps of a method for controlling the power supply current of an electric lamp. The method may be implemented by control device 6 which has just been described. This method may be implemented in a microprocessor in software form or in the form of logic circuits.

Generally, the method comprises a first initialization step S1, a second step S2 of generation of maximum authorized current threshold SeuilMaxAuto, and a third step of limitation of power supply current In. At initialization step S1, the data input by the user, especially SeuilMax, SeuilMin, and Dauto are recovered, and certain parameters are updated. Generation step S2 is periodically carried out at each cycle time Tcycle. Generation step S2 comprises a measurement acquisition step S3 where current Icons consumed during cycle time Tcycle is especially measured, and the value of lighting current set point Id is determined. Generation step S2 further comprises a parameter calculation step S4, a maximum authorized current limitation step S5, and a step S6 of control of the value of intermediate parameter NEDisp. During parameter calculation step S4, the value of the parameters necessary to calculate maximum authorized current ImaxAuto is determined. The following parameters are especially calculated: intermediate parameter NEDisp, parameter Ratio, and parameter ImaxAuto. Then, during step S5, maximum authorized current ImaxAuto is limited so that its value ranges within interval [SeuilMin; SeuilMax]. Further, control step S6 enables to determine the value of maximum authorized current threshold SeuilMaxAuto not to be exceeded by power supply current In to guarantee an autonomous operation during service time Dauto of lamp 1. Control step S6 comprises a step S7 during which the value of parameters NEDisp and Dutil is compared.

When NEDisp≥0 and Dutil<Dauto, that is, as long as service time Dutil is shorter than autonomy time Dauto, the control of power supply current In is maintained to ensure the autonomy of lamp 1. Further, when intermediate parameter NEDisp is positive or zero, it is considered that there is an overconsumption and, in this case, a step S8 is carried out, during which the value of lighting current set point Id is compared with the value of maximum authorized current ImaxAuto. If lighting current set point Id is higher than the calculated maximum authorized current ImaxAuto, a step S9 during which the value of maximum authorized current threshold SeuilMaxAuto is assigned the value of maximum authorized current ImaxAuto is carried out, and a step S10 during which maximum authorized current threshold SeuilMaxAuto is assigned the value of lighting current set point Id is carried out otherwise.

Conversely, when intermediate parameter NEDisp is negative, it is considered that there is an underconsumption and, in this case, step S10 where maximum authorized current threshold SeuilMaxAuto is assigned the value of lighting current set point Id is carried out. Further, when Dutil≥Dauto, that is, if service time Dutil is greater than or equal to autonomy time Dauto, the method for controlling power supply current 1 comes to an end.

During limiting step S11, the power supply current provided to the LED is controlled so that the value of the power supply current is smaller than or equal to maximum authorized current threshold SeuilMaxAuto. Preferably, a power supply current having a value equal to the maximum authorized current threshold is provided to the LED to optimize the lighting power according to the available capacity of the storage unit. It should be noted from FIG. 2 that, after initialization step S1, control step S6 is first performed since at the beginning of the control process, the value of parameter NEDisp is zero. Then, power supply current limitation step S11, generation step S2, and again limitation step S11 are carried out periodically according to time period Tcycle. Due, in particular, to the saving of intermediate parameter NEDisp, the method guarantees an autonomy even after a stopping of lamp 1. Further, the user may modify values SeuiMin, SeuilMax, and Dauto during the lamp use.

To illustrate the steps of the method just described, the following example may be taken:

CapaInit=2000 mAh (or milliamperes hour);
SeuiMax=700 mA;
SeuilMin=50 mA;
Dauto=4 hours;
Tcycle=1 hour;
Margin=0.9;
Imoyen=CapaInit/Dauto=2000/4=500 mA.

At the starting of the process, during the first hour of use, that is, at Dutil=0 hour, for example, lighting current set point is Id=200 mA. Initialization step S1 is then carried out, followed by control step S6 where NEDisp=0 and ImaxAuto=SeuilMax=700 mA. During control step S6, step S7 is carried out, followed by steps S8 and S10. Then, step S11 during which power supply current In is limited to value SeuilMaxAuto=Id=200 mA is carried out. Accordingly, during the first hour of lamp use, power supply current In will always be lower than or equal to 200 mA, preferably equal to 200 mA.

During the second hour of use, that is, at Dutil=1 hour, for example, lighting current set point Id=700 mA. Further, lamp 1 has consumed current Icons=200 mA during previous cycle time Tcycle=1 hour. Calculation step S4 is then carried out, during which the following is calculated:

CapaRest=CapaInit−CapaUtil=2000−200=1800 mAh; and

NEDisp=NEDisp+(*I*cons−*I*moyen*Margin)***T*cycle=0+(200−500*0.9)*−250.

Further, the following is calculated:

Ratio=NEDisp/CapaRest=−250/1800=−0.1388; and

*I*maxAuto=(SeuilMax−SeuilMin)*(1−Ratio)=(700−50)*(1+0.1388)=740.22 mA.

Then, control step S6 during which steps S7 and S10 are carried out is performed again. Then, step S11 during which power supply current In is limited to value SeuilMaxAuto=Id=700 mA is carried out.

Then, during the third hour of use, that is, at Dutil=2 hours, for example, lighting current set point Id=700 mA. Further, lamp 1 has consumed current Icons=700 mA during previous cycle time Tcycle=1 hour. Calculation step S4 is then carried out, during which the following is calculated:

CapaRest=CapaInit−CapaUtil=2000−(200+700)=1100 mAh; and

NEDisp=NEDisp+(*I*cons−*I*moyen*Margin)***T*cycle=−250+(700−500*0.9)*1=0.

Further, the following is calculated:

Ratio=NEDisp/CapaRest=0/1100=0; and

*I*maxAuto=(SeuilMax−SeuilMin)*(1−Ratio)=(700−50)*(1−0)=650 mA.

Then, steps S7, S8, and S9, followed by step S11 during which power supply current In is limited to value SeuilMaxAuto=ImaxAuto=650 mA, are carried out.

Then, during the fourth and last hour of use, that is, at Dutil=3 hours, for example, lighting current set point Id=700 mA. Further, lamp 1 has consumed current Icons=650 mA during previous cycle time Tcycle=1 hour. Calculation step S4 is then carried out, during which the following is calculated:

CapaRest=CapaInit−CapaUtil=2000−(200+700+650)=450 mAh;

and NEDisp=NEDisp+(*I*cons−*I*moyen*Margin)***T*cycle=0+(650−500*0.9)*1=200.

Further, the following is calculated:

Ratio=NEDisp/CapaRest=200/450=0.444; and $$ImaxAuto=(SeuilMax-SeuilMin)*(1-Ratio)=(700-50)*(1-0.444)=361.4\ mA.$$

Steps S7, S8, and S9, followed by step S11 during which power supply current In is limited to value SeuilMaxAuto=ImaxAuto=361.4 mA, are then carried out. During the last hour of use, power supply current In provided to the LED is equal to 361.4 mA. Accordingly, at the end of the control process, CapaRest=CapaInit CapaUtil=2000–(200+700+650+361.4)=88.6 mAh. A minimum lighting current equal to minimum threshold SeuilMin has thus been guaranteed for lamp service time Dauto. Further, the lighting generated by lamp 1 has been optimized to provide a maximum power supply current during each cycle time.

Such a lamp provided with a device for controlling the power supply current is particularly adapted to an automated use of the lamp. For example, when the user desires to light his path, with no external power input and without being concerned about the setting of the lighting generated by the lamp. Such a device enables to provide a lighting optimized according to what current has already been consumed and according to what remains to be provided during the remaining service time, while ensuring an autonomous operation of the lamp.

The invention claimed is:

1. A portable electric lamp comprising:

a lighting module, a compact housing enclosing an electric power storage unit configured to provide a power supply current to the lighting module, a measurement device configured for measuring a current consumed by the lighting module, a power supply current limiter configured to limit the power supply current, and an electronic control unit connected to the electric power storage unit and to the lighting module, the electronic control unit comprising a non-volatile memory saving a lamp autonomy time and being configured for:

generating a lighting current set point, calculating an average current threshold equal to the ratio of an initial capacity of the storage unit estimated by the electronic control unit to the lamp autonomy time, calculating a maximum authorized current from a difference between the consumed current and the average current threshold, calculating a maximum authorized current threshold from the minimum value between the lighting current set point and the maximum authorized current, and controlling the power supply current limiter to limit the power supply current to a value lower than or equal to the maximum authorized current threshold.

2. A portable electric lamp comprising:

a lighting module, a compact housing enclosing an electric power storage unit configured to provide a power supply current to the lighting module, a measurement device configured for measuring a current consumed by the lighting module, a power supply current limiter configured to limit the power supply current, and an electronic control unit connected to the electric power storage unit and to the lighting module, the electronic control unit comprising a non-volatile memory saving a lamp autonomy time and being configured for:

generating a lighting current set point, calculating a maximum authorized current from a difference between the consumed current and a reference current, calculating a maximum authorized current threshold from the minimum value between the lighting current set point and the maximum authorized current, and controlling the power supply current limiter to limit the power supply current to a value smaller than or equal to the maximum authorized current threshold.

3. The lamp according to claim 2, wherein the electronic control unit estimates an initial capacity of the storage unit and calculates the reference current from the initial capacity of the storage unit and the lamp autonomy time.

4. The lamp according to claim 3, wherein the electronic control unit calculates the reference current from a remaining capacity of the storage unit and a remaining lamp service time.

5. The lamp according to claim 1, further comprising an optical sensor configured to generate a signal representative of the lighting induced by the lamp, the electronic control unit further configured for generating the lighting current set point from the generated signal.

6. The lamp according to claim 1, wherein measuring the current consumed by the lighting module includes periodically measuring the current consumed by the lighting module during a determined time period, and the electronic control unit periodically calculates the maximum authorized current and the maximum authorized current threshold at each determined time period.

7. The lamp according to claim 1, wherein the electronic control unit estimates the initial capacity of the storage unit from a coefficient representative of the aging of the storage unit estimated from a number of full charges of the storage unit or from an internal resistance of the storage unit.

8. A method for controlling a power supply current provided by an electric power storage unit to a lighting module of a portable electric lamp, the method comprising:

generating a maximum authorized current threshold; and limiting the power supply current to a value lower than or equal to the maximum authorized current threshold;

wherein generating the maximum authorized current threshold comprises:

measuring a current consumed by the lighting module, generating a lighting current set point, estimating an initial capacity of the storage unit, saving a lamp autonomy time, calculating an average current threshold equal to the ratio of the initial capacity of the storage unit to the lamp autonomy time, calculating a maximum authorized current from a difference between the consumed current and the average current threshold, and calculating the maximum authorized current threshold from the minimum value between the lighting current set point and the maximum authorized current.

9. A method for controlling a power supply current provided by an electric power storage unit to a lighting module of a portable electric lamp, the method comprising;

generating a maximum authorized current threshold; and limiting the power supply current to a value lower than or equal to the maximum authorized current threshold;

wherein generating the maximum authorized current threshold comprises:

measuring a current consumed by the lighting module, generating a lighting current set point, saving a reference current, calculating a maximum authorized current from a difference between the consumed current and the reference current, and calculating the maximum authorized current threshold from the minimum value between the lighting current set point and the maximum authorized current.

10. The method according to claim 9, wherein the reference current is calculated from an initial capacity of the storage unit and a lamp autonomy time.

11. The method according to claim 10, wherein the reference current is calculated from a remaining capacity of the storage unit and a remaining lamp service time.

12. The method according to claim 8, wherein the lighting current set point varies according to a lighting induced by the lamp.

13. The method according to claim 8, wherein the step of generating the maximum authorized current threshold is periodically carried out during a determined time period, and the current consumed by the lighting module is measured during the determined time period.

14. The method according to claim 8, wherein the step of estimating the initial capacity of the storage unit includes estimating the initial capacity of the storage unit from a coefficient representative of the aging of the storage unit estimated from a number of full charges of the storage unit or from an internal resistance of the storage unit.

15. The lamp according to claim 1, wherein the electronic control unit is configured for controlling the power supply limiter to limit the power supply current while current is being provided to the lighting module.

16. The lamp according to claim 2, wherein the electronic control unit is configured for controlling the power supply limiter to limit the power supply current while current is being provided to the lighting module.

17. The method according to claim 8, wherein the step of limiting the power supply current is performed while current is being provided to the lighting module.

18. The method according to claim 9, wherein the step of limiting the power supply current is performed while current is being provided to the lighting module.

* * * * *